US005186111A

United States Patent [19]

Baria

[11] Patent Number: 5,186,111

[45] Date of Patent: Feb. 16, 1993

[54] DEVICE FOR INJECTING SLUDGE INTO AN INCINERATOR

[76] Inventor: Guy Baria, 64, Boulevard du Jardin Exotique, Monte Carlo - 98000, Monaco

[21] Appl. No.: 684,961

[22] PCT Filed: Sep. 20, 1990

[86] PCT No.: PCT/FR90/00680

§ 371 Date: May 20, 1991

§ 102(e) Date: May 20, 1991

[87] PCT Pub. No.: WO91/04445

PCT Pub. Date: Apr. 4, 1991

[30] Foreign Application Priority Data

Sep. 21, 1989 [MC] Monaco ..... PV 2072

[51] Int. Cl.[5] ..... F23G 5/06; F23G 7/04

[52] U.S. Cl. ..... 110/238; 110/262; 110/265

[58] Field of Search ..... 110/238, 262, 265

[56] References Cited

U.S. PATENT DOCUMENTS 3,822,654 7/1974 Ghelfi ..... 110/238
4,094,625 6/1978 Wang et al. ..... 110/238
4,206,711 6/1980 Konrad ..... 110/346
4,462,318 7/1984 Carbeau et al. ..... 110/244
4,785,746 11/1988 Roy et al. ..... 110/238

*Primary Examiner*—Henry C. Yuen
*Attorney, Agent, or Firm*—Pollock, VandeSande & Priddy

[57] ABSTRACT

Device making it possible to effect the injection of sludge originating, in particular, from sewage-purification stations, into the combustion chamber of an incinerator, in particular of a household-refuse incinerator, characterized in that it comprises at least one injector (10) of small diameter, traversing the thermal-projection means of the combustion chamber and fed, at a constant rate for all of the injectors, via a distribution chamber (12), each injector consisting of a tube (18) having a cylindrical shape and comprising a conical nozzle (20), on the combustion chamber side, with the large diameter situated on the side of the outlet of the sludge from the injector, and in that each injector is thermally regulated in order to obtain a linear temperature gradient along the whole length of the injector, causing the formation in the injector, as the injection progresses, of a cylindrical element of sludge having a predetermined diameter and a surface crust in the zone close to the combustion chamber.

11 Claims, 4 Drawing Sheets

DEVICE FOR INJECTING SLUDGE INTO AN INCINERATOR

The present invention relates to a device making it possible to introduce sludge, by injection, into the combustion chamber of an incinerator.

BACKGROUND OF THE INVENTION

It is known that the combustion of sludge originating from sewage-purification stations can be effected in a furnace for incinerating household refuse. However, this combustion gives rise to problems which are difficult to overcome, in particular due to the high moisture content of the sludge and to the need for ensuring a regular and homogeneous introduction of the sludge into the incineration furnace.

There currently exist various methods and devices which are used for introducing sludge into furnaces for incinerating household refuse, among which there may be mentioned, in particular:

the introduction of sludge to the feed chute receiving the refuse with the aid of a feed system, for example of the Archimedes screw type. Such a solution gives rise to heterogeneities in the concentration of the sludge in the region of the feed screw, which is translated into poor combustion;

the prior conditioning of the sludge to form granules with a low moisture content which are introduced into the combustion chamber of the incineration furnace at the same time as the household refuse, in the feed hopper of the latter. This known technique requires a heat-drying operation which is costly in terms of energy and investment, not to mention handling, treatment and transport of the sludge, which, of course, increases the cost price and can be the cause of pollution for the operating staff;

the spraying of the sludge onto the combustion grid of the incinerator with the aid of a feed system which breaks up this sludge which is to be spread over the combustion grid. The difficult problem to overcome here is that of calibrating the sludge and spreading it over the surface of the combustion grid.

SUMMARY OF THE INVENTION

The present invention proposes to provide a solution which departs from the solutions used previously in order to ensure the introduction of the sludge into the combustion chamber of an incinerator, permitting a homogeneous feeding of the sludge by injection into the combustion chamber at a constant rate and in a form ensuring a rapid and pollution-free combustion.

Consequently, the subject of the present invention is a device making it possible to effect the injection of sludge originating, in particular, from sewage-purification stations, into the combustion chamber of an incinerator, in particular of a household-refuse incinerator, characterised in that it comprises at least one injector of small diameter, traversing the thermal-protection means of the combustion chamber and fed, at a constant rate for all of the injectors, via a distribution chamber, each injector consisting of a tube having a cylindrical shape and comprising a conical nozzle, on the combustion chamber side, with the large diameter of the nozzle situated on the side of the outlet of the sludge from the injector, and in that each injector is thermally regulated in order to obtain a linear temperature gradient along the whole length of the injector, causing the formation in the injector, as the injection progresses, of a cylindrical element of sludge having a predetermined diameter and a surface crust in the zone close to the combustion chamber.

According to a feature of the present invention, the diameter of each of the injectors lies between 10 and 40 mm.

According to the invention, each of the injectors is equipped with a cooling system designed so as to circulates a cooling fluid, in particular water, in an enclosure defined between the injection tube and a sleeve surrounding the tube on the injectorfoot side, the injection of the cooling fluid, such as water, into the said enclosure taking place through a feed line opening out into this enclosure beneath the injection tube, on the injector-foot side, this cooling fluid vaporising in the enclosure.

According to another feature of the device which is the subject of the present invention, the distribution chamber has a tubular general shape, with a constant cross-section, and the surface area of its cross-section perpendicular to its longitudinal axis is greater than the sum of the surface areas of the inlet cross-sections of the injection tubes which open out into the lower part of this distribution chamber. The feeding of sludge into this distribution chamber can be effected either through one of its ends or from its upper surface, an outlet for draining being provided at one of the ends of the feed chamber.

According to the present invention, means are provided which make it possible to unplug and/or clean and/or seal-off the various injectors, each of these means consisting of a rod traversing the distribution chamber and penetrating into the tube of the corresponding injector as far as the conical part of the latter, the diameter of each of the rods being less than that of the bore of the cylindrical part of the injection tube. These rods can be manoeuvred either manually or by any appropriate drive device such as, in particular, actuators. They can be provided with return means.

According to the invention, the sealing of each of the said rods through the body of the distribution chamber is ensured by a system of seals and a grease box, and the cooling of each of the rods when it is withdrawn from the corresponding injection tube, after unjamming and/or sealing-off, is obtained by the rod passing through the mass of sludge present in the distribution chamber and through the grease contained in the said grease box.

Other features and advantages of the present invention will become apparent from the description below, made with reference to the attached drawings which illustrate an embodiment of the invention which implies no limitation. In the drawings:

DETAILED DESCRIPTION OF THE INVENTION

Figure 1:
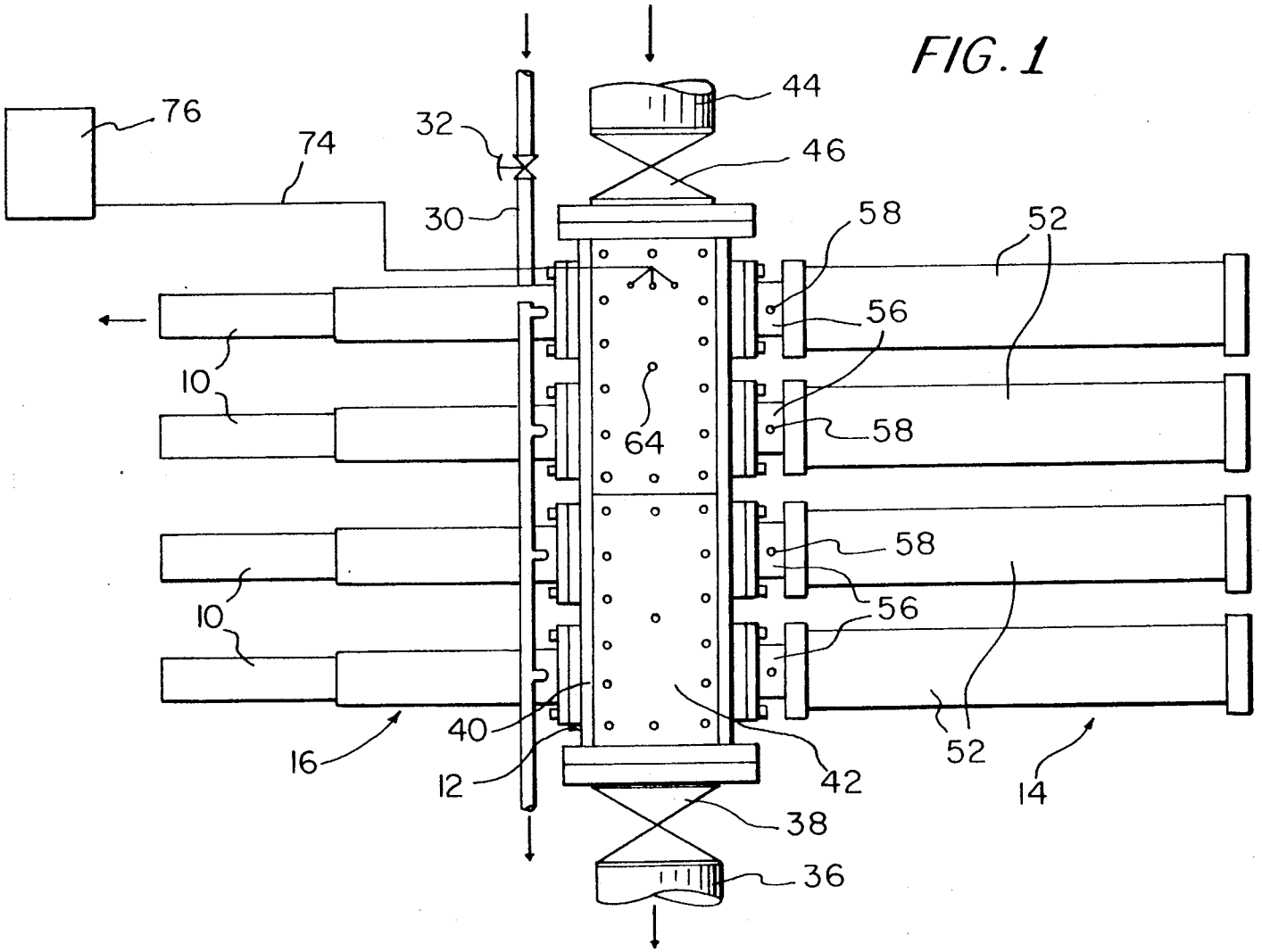
FIG. 1 is a diagrammatic plan view from above, illustrating an embodiment of the device which is the subject of the present invention.

As stated above, the device which is the subject of the invention comprises at least one injector making it possible to introduce the sludge into the combustion chamber of an incinerator, traversing the thermal protections of this chamber or of the screens of furnaces or boilers. The problem overcome by the invention is to provide a homogeneous feeding at a constant rate of the sludge into this combustion chamber and, to this end, in accordance with the invention, the sludge is extruded through each injector which is thermally regulated so as to calibrate the roll of sludge introduced in this way into the combustion chamber.

Referring to the drawings, it can be seen that the device which is the subject of the present invention essentially comprises the following elements:

at least one injection tube designated as a whole by the reference 10;

a chamber 12 of a special configuration making it possible to effect a homogeneous distribution at a constant rate from each injector 10 opening out into this distribution chamber;

means designated as a whole by the reference 16, making it possible to effect the cooling of the injectors 10;

means designated as a whole by the reference 14, which are designed so as to ensure an unjamming and/or a cleaning and/or a sealing-off of each injector 10; and means making it possible to effect a draining and a cleaning when the device is at a standstill for a prolonged period of time.

It is also possible to provide, according to the invention, a system for managing, by an automatic machine, the various controls and safety devices of this sludge-injection device.

Figure 2:
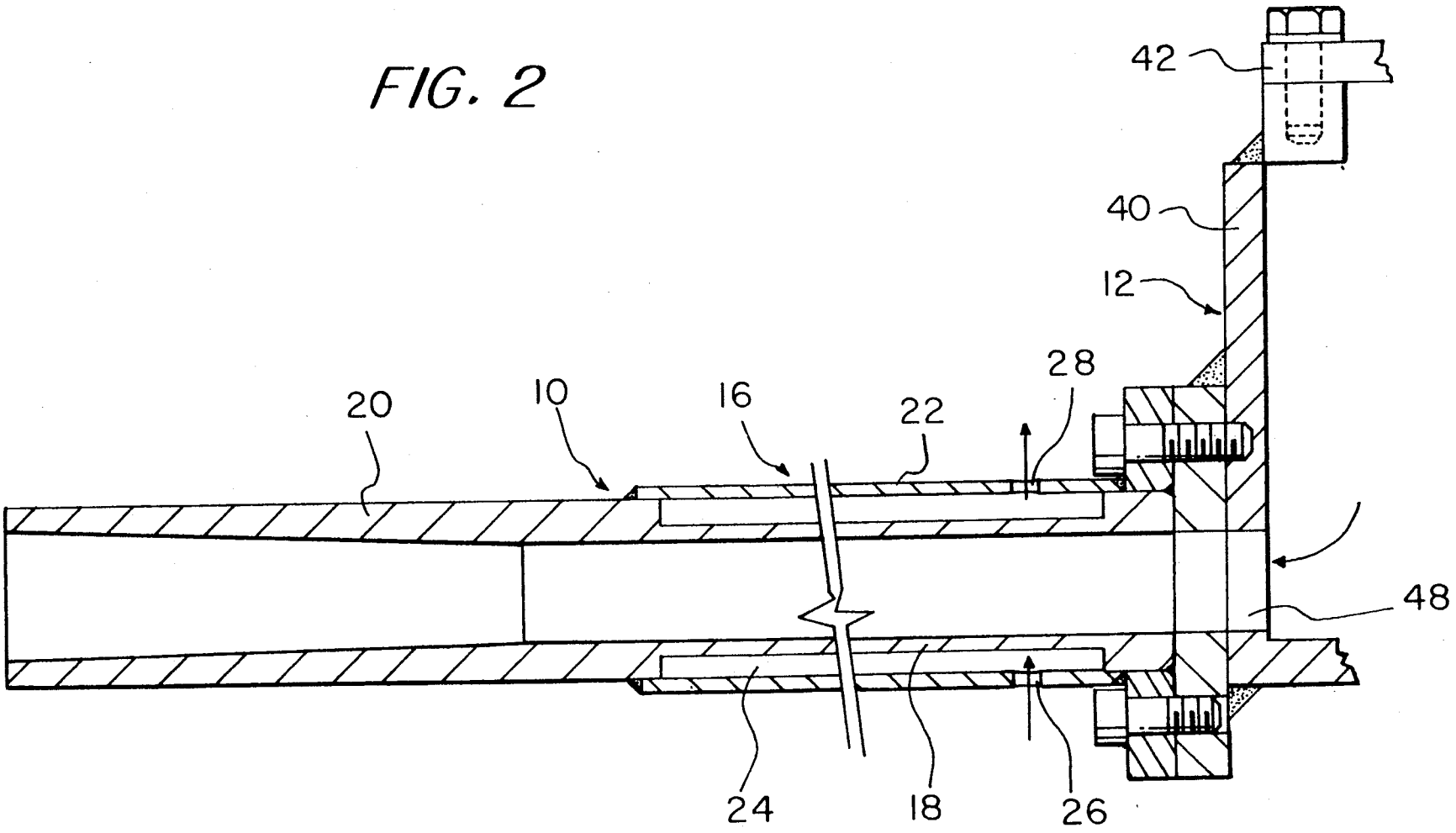
FIG. 2 is a detailed view showing, in vertical axial section, a sludge injector in accordance with the present invention.

Referring more particularly to FIG. 2, it can be seen that each injector consists of a tube 18 of cylindrical shape, the outlet 20 side of which has a conical shape with a large diameter situated on the side of the outlet of the sludge, in particular in order to prevent jamming, as will be described below. The other end of the injection tube 18 is fixed to the distribution chamber 12 by any appropriate means, for example by a system of flanges and nuts, as can be seen clearly in FIG. 2.

Each of the injectors has a small inlet diameter which, according to the present invention, lies between 10 and 40 mm. Its length is, for example, of the order of 350 mm between the inlet of the sludge at the foot of the injector and its outlet at the end of the nozzle 20 of the latter.

Figure 4:
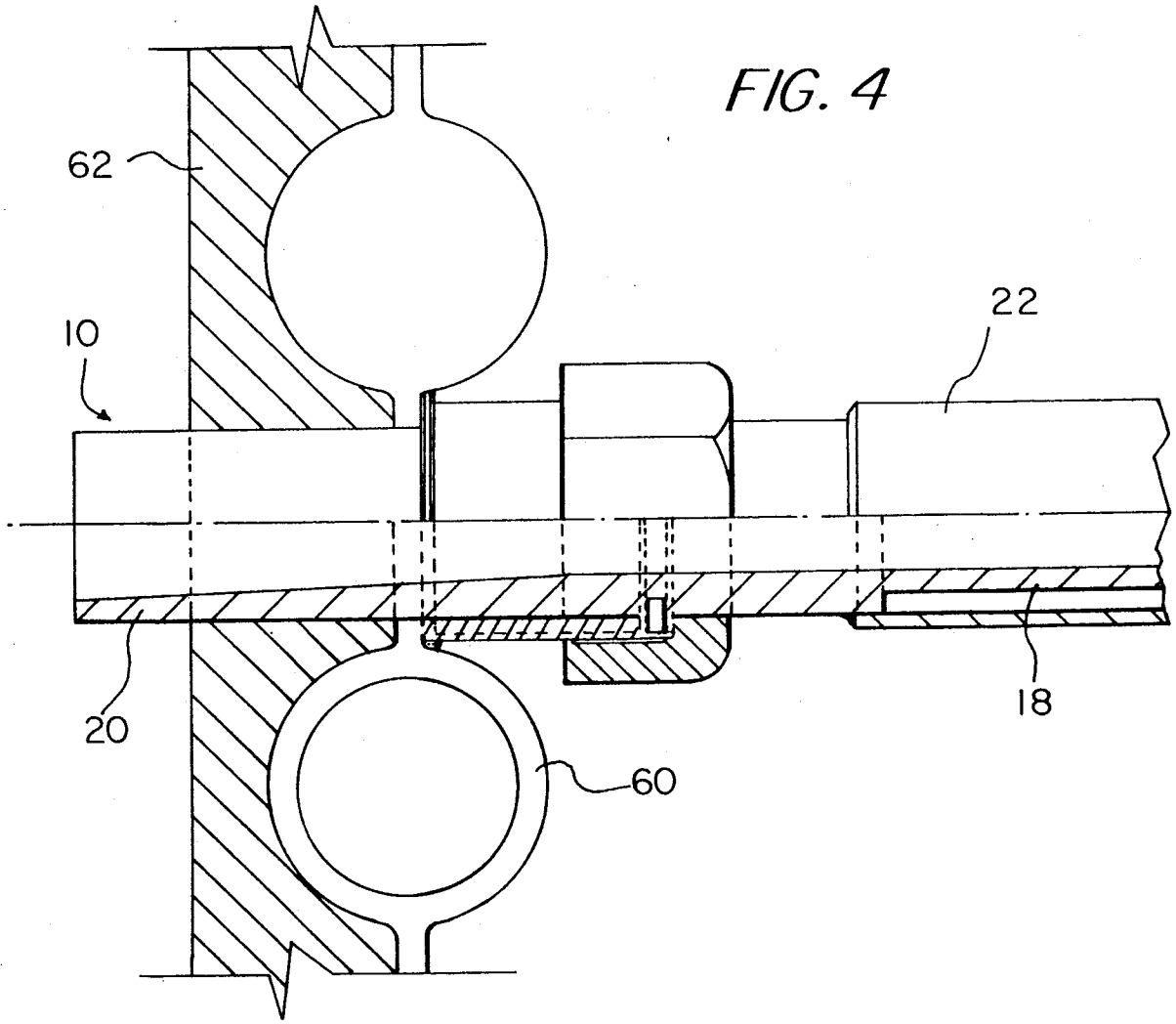
FIG. 4 is likewise a detailed view in partial section through a vertical plane illustrating an example of the mounting of a sludge injector on the wall of the combustion chamber of an incinerator.

FIG. 4 illustrates, by way of non-limiting example, a method of mounting an injector 10 on the fin of the screen tubes 60 of the wall 62 of a furnace for incinerating household refuse. It is possible to envisage other fixing systems, for example directly onto the structure of the combustion chamber or in the masonry of an incinerator not fitted with a recovery system.

Figure 3:
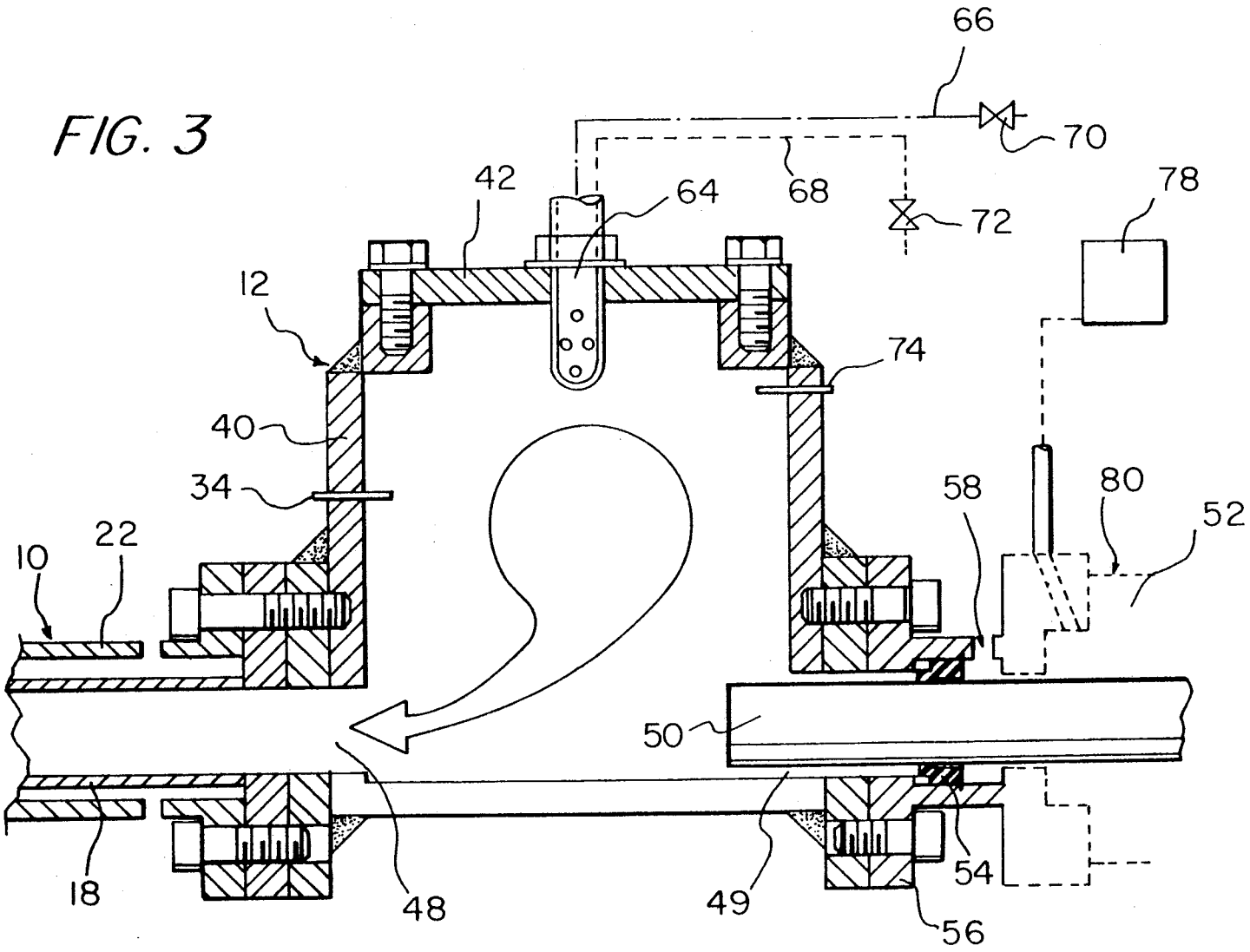
FIG. 3 is likewise a detailed view in section through a vertical plane along the axis of an injector and of its corresponding cleaning and/or sealing-off rod.

The feeding of sludge to each injector such as 10 is effected with the aid of the distribution chamber 12 to which the sludge is delivered with the aid of a feed pump (not shown in the drawing). As can be seen in FIG. 3, this chamber is in the form of a body 40 of a tubular general shape, the upper part 42 of which can be removed so as to be able to serve as an inspection flap. The introduction of the sludge into this distribution chamber can be made either through one of the end walls of the chamber or with the aid of an introduction orifice provided on the upper part 42 of the body of this chamber. In the non-limiting illustrative embodiment shown in the drawing, the introduction of the sludge is effected via a feed pipe 44, at one of the ends of the body 40, on which pipe an inlet valve 46 has been provided. The end of the body of the distribution chamber opposite the sludge inlet (pipe 44) is provided with a sewer-connection pipe 36 equipped with a valve 38.

As can be seen in FIG. 3, the lower part of the body 40 of the distribution box comprises orifices 48 into each of which opens an injector. According to the invention, in order to ensure a homogeneous feed at a constant rate of each injector such as 10, the surface area of the cross-section perpendicular to its longitudinal axis, of the distribution chamber 12, is greater than the sum of the surface areas of the orifices 48 through which the feeding of sludge to each injector tube takes place.

The part situated on the foot side of each injector (in other words on the distribution chamber 12 side) is equipped with a sleeve 22 surrounding the cylindrical tube 18, thus creating a chamber 24 in which circulates a cooling fluid, in particular water, which is vaporised in the said chamber. This cooling fluid is introduced into the chamber 24 by way of a feed pipe which opens out into an orifice 26 provided beneath the lower part of the sleeve 22 as can be seen in FIG. 2, this orifice 26 being situated in proximity to the foot of the injector. The outlet of the cooling fluid takes place through an orifice 28 arranged on the sleeve 22 opposite the orifice 26. In FIG. 1 there can be seen a tube 30 which makes it possible to ensure the feeding of cooling fluid. Because this cooling fluid is introduced at the bottom of the tube of each injector, it is possible to obtain a difference in level with the outlet orifice 28, thus constituting a guard, it being possible for the solid surplus to be poured, if necessary, into the sewer-connection tube 36 of the body of the distribution chamber 12 downstream of the draining valve 38 of this body. The flow rate of this fluid can be adjusted either manually or automatically using a valve 32 mounted on the tube 30, it being possible for this valve to be pilot-controlled in terms of flow rate by a sensor and a temperature regulator 34 which are placed on the wall of the distribution chamber 12 (FIG. 3).

The cooling of the injectors such as 10 by the circulation of water is necessary, in particular, in the case of a rise in temperature above the acceptable limit for all the components forming the device, the cooling during the injection of the sludge being obtained by the circulation of the sludge through the injector.

The invention provides means making it possible to ensure an unjamming and/or a cleaning and/or a sealing-off in each injector tube. In the illustrative embodiment shown in the drawings, and more particularly in FIG. 3, these means comprise, for each injector, a rod 50 which traverses the wall of the body 40 of the distribution chamber through an orifice 49 which is situated opposite the orifice 48 through which the feeding of sludge to the injector in question takes place. This rod has a diameter which is less than that of the tube 18 of the injector, and its travel is determined in such a way that it penetrates into this tube as far as the conical part 20 of the latter. By way of non-limiting example, it will be indicated that, for an injector inlet diameter value of 22 mm, each unjamming rod will have a diameter of 20 mm. The end piece of the rod 50 serves as a punch with the orifice 48. The rods such as 50 can be actuated by any appropriate means, in particular with the aid of pneumatic actuators 52, hydraulic actuators 52 supplied with the aid of a distributor 78, or mechanical actuators. A system of seals, for example a lip seal 54, is placed in between each rod 50 and a spacer 56 joining together the body 40 of the distribution chamber and the cylinder of each actuator 52, and a grease box 58 is furthermore provided which is placed in front of the fixing means of each actuator 52.

When the sludge is injected, each rod such as 50 is in the retracted position, as shown in FIG. 3, and the advancing and withdrawing movements of the rod such as 50 take place only in the event of an injector being jammed. In this case, each time the device is at a standstill for a prolonged period of time, the rod 50 is introduced into the tube of the corresponding injector and it is held in this position in order to fulfill the following functions:

stopping the injection of the sludge;

blocking the inlet into the device of the gases or of the high temperatures prevailing in the incinerator;

preventing the sludge from drying up;

isolating the sludge-feed body from the distribution chamber 12 with a view to cleaning it.

It will be noted that, according to the present invention, each rod 50, when it is withdrawn from an injector 10 after unjamming, is cooled by passing through the mass of sludge which is contained in the distribution chamber 12 and then by passing through the grease enclosed in the grease box 58. Moreover, the presence of this grease which is deposited in the form of a thin film on the outer periphery of the rod 50 makes it possible to ensure a self-cleaning of this rod, preventing the sticking of the sludge.

Means are also provided making it possible to drain and clean the above-described device when the device according to the invention is at a standstill for a prolonged period of time. Indeed, in the event of the device being at a standstill, it is necessary to drain and clean the distribution chamber 12 in order to prevent the sludge from accumulating and drying up in this chamber.

The device therefore comprises cleaning nozzles such as 64 which are preferably arranged on the upper part 42 of the distribution chamber 12 (see FIG. 3), it being possible for these nozzles 64 to be alternately supplied with compressed air and with pressurised water respectively via supply circuits 66, 68 provided with valves 70 and 72.

The draining is performed by closing the sludgesupply valve 46, by opening the valve 70 of the compressed-air circuit 66 in order to supply the cleaning nozzles 64 opening out into the distribution chamber 12. The sludge contained in this chamber is expelled through the injector or injectors such as 10, and the level of the sludge in the chamber 12 falls as far as the upper part of the holes 48 into which the injectors open. The compressed-air intake valve 70 is then closed, the injectors are sealed off by the rods 50, the sewer-connection valve 38 is opened and the cleaning-water intake valve 72 is opened. This water introduced into the distribution chamber 12, via the nozzles 64, cleans this chamber and the residues are expelled to the sewer through the sewer connection tube 36. When the cleaning is finished, the valve 72 is closed again. When the injection device is started up again, the valve 38 is closed, the sludge-supply valve 46 is opened and the device can be started up again, it being understood that the rods 50 are in the retracted position. The feeding of sludge to the injectors can then be resumed.

It will be noted that this system of cleaning nozzles 64 can also be used for the introduction under pressure of a disinfectant product into the distribution chamber.

The device which is the subject of the invention makes it possible to effect a homogeneous feeding at a constant rate of the sludge into the combustion chamber of an incinerator. This feeding takes place in the form of a cylindrical element which is extruded through each of the injectors. Taking into account the regulation of the temperature according to a linear gradient along the whole length of each of the injectors, geneous feed elements having a predetermined diameter are obtained. Furthermore, the feature according to which the nozzle of each injector has a conical shape makes it possible for the hot gases originating from the combustion chamber to penetrate between the outer periphery of the cylindrical element formed and the wall of the nozzle of the injector which causes the formation of a surface crust on the cylindrical element, improving the combustion of the latter and effecting, moreover, a self-cleaning of the end of each injector.

According to the present invention, it is preferable to use a plurality of injectors which are regularly distributed along the length of the base of the distribution chamber. Excellent results have been obtained for an incineration furnace having a throughput of 6 tons/-hour of household refuse with a device according to the invention as described above comprising 22 injectors, each having an internal diameter of 22 mm, the hourly injection throughput of sludge then being 1 ton/hour, the sludge injected having a dry-matter content of 25%. The injection pressure in the distribution chamber 12 was 0.8 bar.

The device which is the subject of the present invention can function without automation with a simple alarm for elevated pressure in the body of the distribution chamber, and a system for controlling the stopping of the pump for feeding the sludge into this chamber when the critical threshold is exceeded, it being possible for this alarm to be controlled from a pressure sensor 74. However, it may be preferable to provide automation, in particular in order to reduce to a very considerable extent the monitoring and maintenance time. Automation makes it possible, according to a feature of the present invention:

to maintain an appropriate pressure inside the distribution chamber 12;

to unjam an injector as soon as the pressure rises;

to check the travel of the rods 50 for unjamming and sealing-off the injectors;

to trigger the alarms;

to pilot-control the pump for feeding the sludge into the distribution chamber 12; and to clean the tubes of the injectors at specified frequencies.

The automation apparatus used comprises pressure sensors 74 placed at the inlet of the distribution chamber, a programmable automatic machine 76, and a system for regulating the cooling, comprising in particular the thermostatic valve 32 provided on the duct 30 for supplying cooling fluid to the injectors.

According to the invention, it is possible to provide three elevated-pressure thresholds:

A first elevated-pressure threshold, which is the lowest, indicating either a jamming of one or more injectors or orifices such as 48 of the distribution chamber 12, or a change in the quality of the injected sludge. An alarm is then triggered.

A second elevated-pressure threshold, when the pressure continues to rise, the automatic machine 76 then sending an electric signal to the distributor 78 of the actuator 52 in question. The rod 50 of this actuator then moves back and forth in the nozzle of the corresponding injection in order to unjam it.

A third elevated-pressure threshold, when the maximum elevated pressure is reached and the automatic machine 76 then stops the electrical supply of the sludge-feed pump.

According to the invention, it is possible to provide a programmed unjamming cycle, the execution of which makes it possible to prevent the pressure thresholds from being reached and to maintain a constant calibration of the roll or rolls of sludge introduced by the injector or injectors into the incinerator.

Lastly, according to the invention, end-of-travel magnetic sensors are provided, shown diagrammatically at 80 in FIG. 3, making it possible to detect operational malfunctions of the unjamming means and to facilitate maintenance.

I claim:

1. Apparatus for injecting waste material as an extruded sludge into a combustion chamber of an incinerator comprising:

a distribution chamber having sludge inlet means;

at least one tubular injector having a bore therethrough, said at least one tubular injector operatively interconnecting said distribution chamber with said combustion chamber for passing sludge therethrough, said at least one tubular injector comprising a tubular stem having a cylindrical base portion connected to said distribution chamber and a sludge outlet nozzle having a conical base portion extending into said combustion chamber, said conical base portion having a wide diameter end at the sludge outlet;

a cooling system for said at least one tubular injector comprising a sleeve secured to and spaced from said tubular stem so that said sleeve and said stem define an enclosed passageway for a cooling fluid, said sleeve having an orifice on a lower portion thereof for controlling the flow of said cooling fluid to obtain a linear temperature gradient along the length of said at least one injector.

2. Apparatus according to claim 1 wherein said base of said at least one tubular injector has a diameter from about 10 to about 40 mm.

3. Apparatus according to claim 1 or 2 wherein said distribution chamber comprises a generally tubular body having a longitudinal axis with a constant cross-sectional area along said axis and wherein a cross-section perpendicular to said axis has an area greater than the sum of the areas of cross-sections of said cylindrical bore portions.

4. Apparatus according to claim 3 wherein said sludge inlet means is positioned at one extremity of said distribution chamber and an outlet for sludge drainage is provided at the other extremity of said distribution chamber.

5. Apparatus according to claim 3 wherein said sludge inlet means is provided on an upper surface of said distribution chamber.

6. Apparatus according to claim 1 including means for cleaning said bore of said at least one tubular injector, said means including a rod adapted to pass through an opening in said chamber wall and penetrate said bore at least as far as said conical base portion, the diameter of said rod being less than the diameter of said cylindrical bore.

7. Apparatus according to claim 6 wherein said means for cleaning said bore includes means for driving said rod.

8. Apparatus according to claim 6 or 7 wherein said means for cleaning said bore includes gaskets and a grease box mounted at said opening and surround said rod.

9. Apparatus according to claim 1 including spray nozzles mounted within said distribution chamber and means for introducing compressed air or water through said nozzle and into said distribution chamber.

10. Apparatus according to claim 6 or 7, including pressure sensors for sensing pressure at said sludge inlet means, and means for cleaning said bore according to programmed intervals.

11. Apparatus according to claim 1 wherein said apparatus is provided with a plurality of injectors.

* * * * *